US005726563A

United States Patent [19]

Bolton, Jr.

[11] Patent Number: 5,726,563

[45] Date of Patent: Mar. 10, 1998

[54] SUPPLY TRACKING TEMPERATURE INDEPENDENT REFERENCE VOLTAGE GENERATOR

[75] Inventor: Jerry T. Bolton, Jr., Plantation, Fla.

[73] Assignee: Motorola, Inc., Schaumburg, Ill.

[21] Appl. No.: 747,182

[22] Filed: Nov. 12, 1996

[51] Int. Cl.[6] ..... G05F 3/16; G05F 3/26

[52] U.S. Cl. ..... 323/315; 323/313

[58] Field of Search ..... 323/313, 314, 323/315, 316

[56] References Cited

U.S. PATENT DOCUMENTS

| | | | |
|---|---|---|---|
| 3,999,084 | 12/1976 | Beaudette | 307/237 |
| 4,442,398 | 4/1984 | Bertails et al. | 323/315 |
| 4,945,260 | 7/1990 | Naghshineh et al. | 307/296 |
| 5,030,903 | 7/1991 | Bernard et al. | 323/313 |
| 5,142,696 | 8/1992 | Koseic et al. | 323/315 |
| 5,224,007 | 6/1993 | Gill, Jr. | 323/316 |
| 5,268,871 | 12/1993 | Dhong et al. | 365/226 |
| 5,315,231 | 5/1994 | Linder et al. | 323/315 |
| 5,339,272 | 8/1994 | Tedrow et al. | 323/315 |
| 5,453,953 | 9/1995 | Dhong et al. | 365/189.09 |
| 5,508,604 | 4/1996 | Keeth | 323/314 |
| 5,512,814 | 4/1996 | Allman | 323/267 |
| 5,532,579 | 7/1996 | Park | 323/316 |
| 5,563,504 | 10/1996 | Gilbert et al. | 323/316 |

*Primary Examiner*—Peter S. Wong
*Assistant Examiner*—Bao Q. Vu
*Attorney, Agent, or Firm*—Andrew S. Fuller

[57] ABSTRACT

A reference voltage generator (100) generates a constant offset reference voltage (125) relative to a reference ground voltage (115) that tracks supply voltage (105). The supply voltage (105) is scaled to derive the reference ground voltage (115). A scaled voltage output (135) is derived from a temperature and supply independent voltage source, such as a bandgap voltage generator. The scaled voltage output (135) is summed with the reference ground voltage (115) to generate the constant offset reference voltage (125). The summing function is preferably performed by an operational amplifier (220) having an input (221) coupled to the scaled voltage output by a MOSFET transistor (242), and another input (222) coupled to the reference ground voltage (115).

22 Claims, 3 Drawing Sheets

SUPPLY TRACKING TEMPERATURE INDEPENDENT REFERENCE VOLTAGE GENERATOR

TECHNICAL FIELD

This invention relates in general to voltage reference generators.

BACKGROUND OF THE INVENTION

There is a need for integrated circuits to support a multiplicity of supply voltage values, while relying on a single voltage supply because of inherent cost advantages of a single supply system. For example, an integrated circuit may be required to operate with supply voltages ranging from 2.7 volts to 5 volts. One problem faced in the design of such integrated circuits is that of ensuring that the same performance specifications are met for a particular function, regardless of the supply voltage.

A frequently needed function in analog signal processing circuits is that of a temperature independent precision voltage reference. A common prior art solution uses a bandgap reference circuit to generate a voltage that is temperature independent and supply voltage independent. The bandgap voltage is typically referenced to a fixed electrical ground. When processing analog signals, it is desirable to have a reference ground about which the analog signal may oscillate. This reference ground is sometimes referred to as "analog ground" and is often set to one half (½) the supply voltage to allow for maximum negative and positive amplitude peaks. When the supply voltage varies, it becomes more difficult to establish a precision voltage reference relative to the analog ground.

The prior art does not adequately provide for circuits that supply a temperature independent precision voltage reference relative to analog ground when the supply voltage varies widely. Therefore, a new supply tracking temperature independent reference voltage generator is needed.

DETAILED DESCRIPTION OF THE PREFERRED EMBODIMENT

The present invention provides a reference voltage generator that tracks supply voltage and that is temperature independent. The reference voltage generator produces a reference voltage that is at a constant voltage offset relative to a reference ground voltage that tracks the supply voltage. The reference ground voltage, sometimes referred to as analog ground for specific applications, is provided as a scaled derivative of the supply voltage, such as half (½) the supply voltage. A scaled voltage from a temperature and supply independent voltage source is summed with the reference ground voltage to generate the constant offset reference voltage. In the preferred embodiment, a bandgap voltage generator outputs a bandgap voltage which is temperature and supply independent. A voltage divider scales the supply voltage to provide the reference ground voltage.

An operational amplifier has one input coupled to the reference ground voltage and another input coupled in a negative feedback loop arrangement to the bandgap voltage by a metal-oxide semiconductor field-effect transistor (MOSFET). A resistor coupling the bandgap voltage output to electrical ground generates a current that is coupled across a resistor in the feedback loop of the operational amplifier to develop the constant offset voltage.

Figure 1:
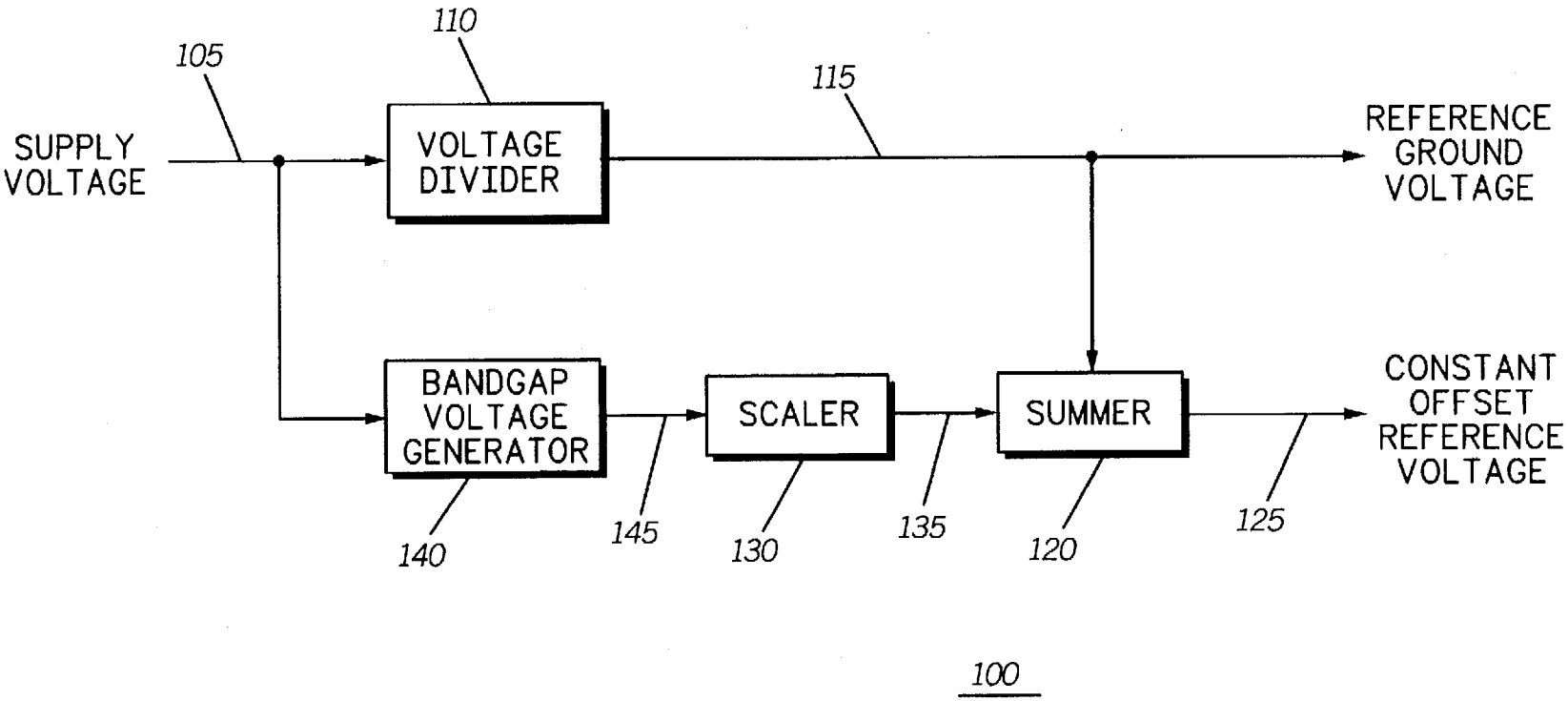
FIG. 1 is a block diagram of a reference voltage generator, in accordance with the present invention.

FIG. 1 is a block diagram of a reference voltage generator 100, in accordance with the present invention. The reference voltage generator 100 includes, as functional blocks, a reference ground voltage source in the form of a voltage divider 110, a summer 120, a scaler 130, and a bandgap voltage generator 140. The voltage divider 110 is coupled to supply voltage 105, and outputs a reference ground voltage 115 that is a scaled derivative of the supply voltage 105. The bandgap voltage generator 140 is a temperature and supply independent voltage source that outputs a bandgap voltage 145. A wide variety of bandgap voltage generators are known in the prior art. The scaler 130 operates to scale the bandgap voltage 145 according to a desired voltage offset relative to the reference ground voltage. The summer 120 sums the scaled bandgap voltage 135 with the reference ground voltage 115 to generate a constant offset reference voltage 125.

Figure 2:
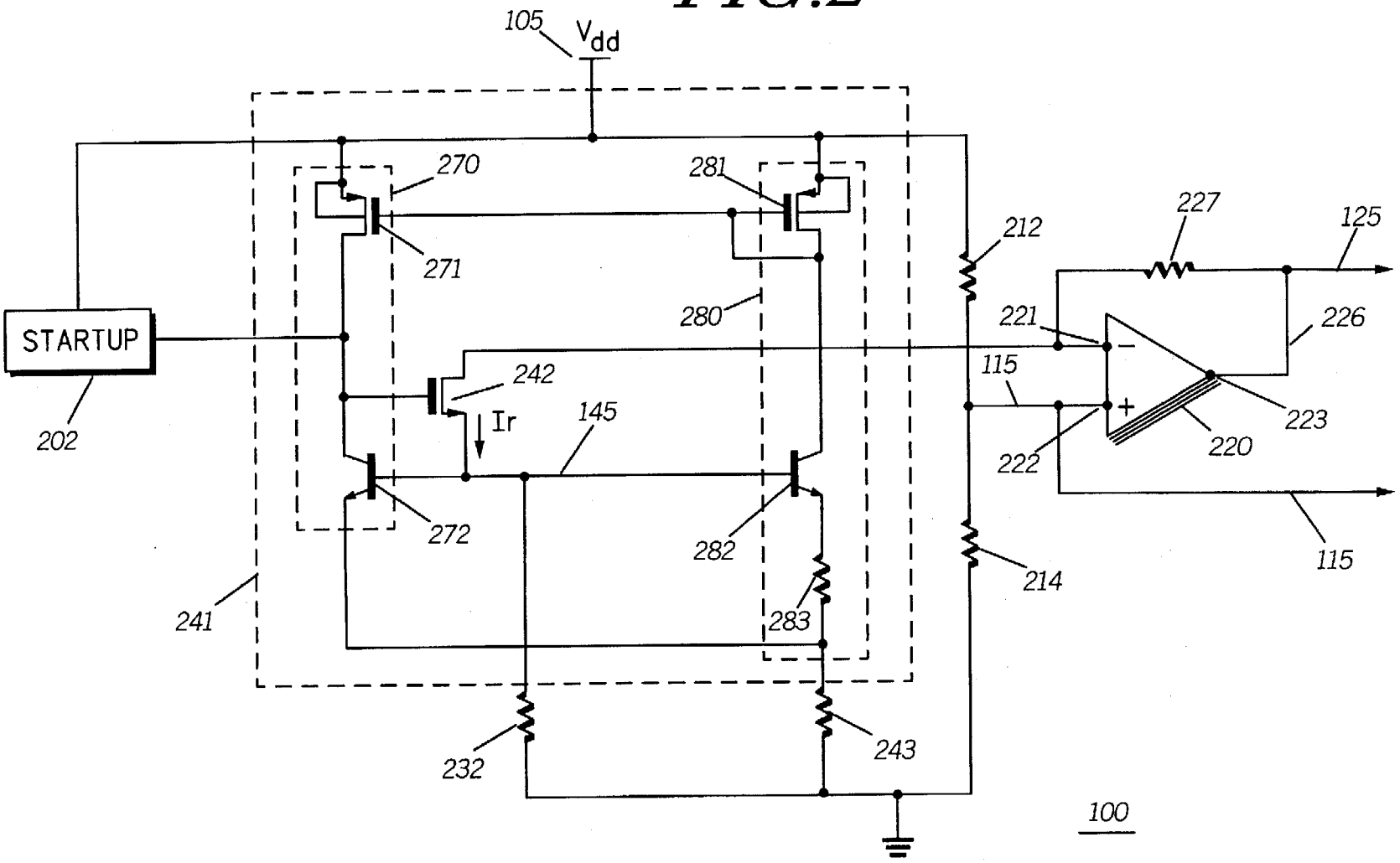
FIG. 2 is a circuit diagram of a particular embodiment of the reference voltage generator of FIG. 1, in accordance with present invention.

FIG. 2 is a circuit diagram of an embodiment of the reference voltage generator 100, in accordance with the present invention. Referring to FIGS. 1 and 2, the voltage divider 110 is formed using first and second resistors 212, 214, which in the preferred embodiment have the same resistive value, such that the reference ground voltage 115 is half (½) that of the supply voltage.

The bandgap voltage generator 140 includes a startup circuit 202 for establishing startup operating conditions. The startup circuit 202 is coupled to a current mirror circuit 241 having two branches 270, 280, connected in parallel, which have one common node coupled to the supply voltage 105, and another common node coupled to electrically ground via a resistor 243. In one branch 270, a P-channel MOSFET (PMOSFET) transistor 271 is coupled in series with a bipolar transistor 272. The PMOSFET transistor 271 has a source connected to the supply voltage 105, and a drain is connected to the collector of the bipolar transistor 272. In the other branch 280, a PMOSFET transistor 281, a bipolar transistor 282, and a resistor 283 are coupled in series. The PMOSFET transistor 281 has a source connected to the supply voltage 105, a drain connected to the collector of the bipolar transistor 282. The bipolar transistor 282 has an emitter connected to the resistor 283. The PMOSFET transistors 271, 281 have gates that are connected to each other, and that are connected to the drain of the PMOSFET transistor 281. The bipolar transistors 272, 282 have connected bases at which the bandgap voltage 145 is developed.

The bandgap voltage generator 140 further includes an N-channel MOSFET (NMOSFET) transistor 242 connected at the bases of the bipolar transistors 272, 282, and operable to reduce current mismatch within the current mirror circuit 241. The NMOSFET transistor 242 has a gate connected to the drain of the PMOSFET transistor 271 and to the collector of the bipolar transistor 272, and a source connected to the bases of the bipolar transistors 272, 282.

The reference voltage generator 100 also includes an operational amplifier 220. The operational amplifier 220 has two inputs 221, 222, and an output 223. The input 222 is connected to the reference ground voltage output 115 of the voltage divider 212, 214. A negative feedback loop 226 includes a resistor 227 which couples the output 223 to one of the inputs 221. The negative feedback of the operational amplifier 220 forces both input terminals 221, 222 to have the same voltage. The input 221 is further connected to the drain of the NMOSFET transistor 242. The NMOSFET transistor 242 couples a current source based on the bandgap voltage output to the input 221. The current source is formed by a resistor 232 that couples the output 145 of the bandgap voltage generator to electrical ground.

The operational amplifier 220 operates to provide the summing function and a portion of the scaling function represented by the summer 120, and the scaler 130. The scaler 130 includes the resistor 232 and the resistor 227. The resistor 232 derives a current $I_r$ from the bandgap voltage, which current is coupled to the input 221 of the operational amplifier 220. The current $I_r$ is used to develop the constant offset voltage 125 across the resistor 227. The constant offset voltage 125 is summed with the reference ground voltage 115 to generate the supply tracking constant offset reference voltage 125.

Figure 3:
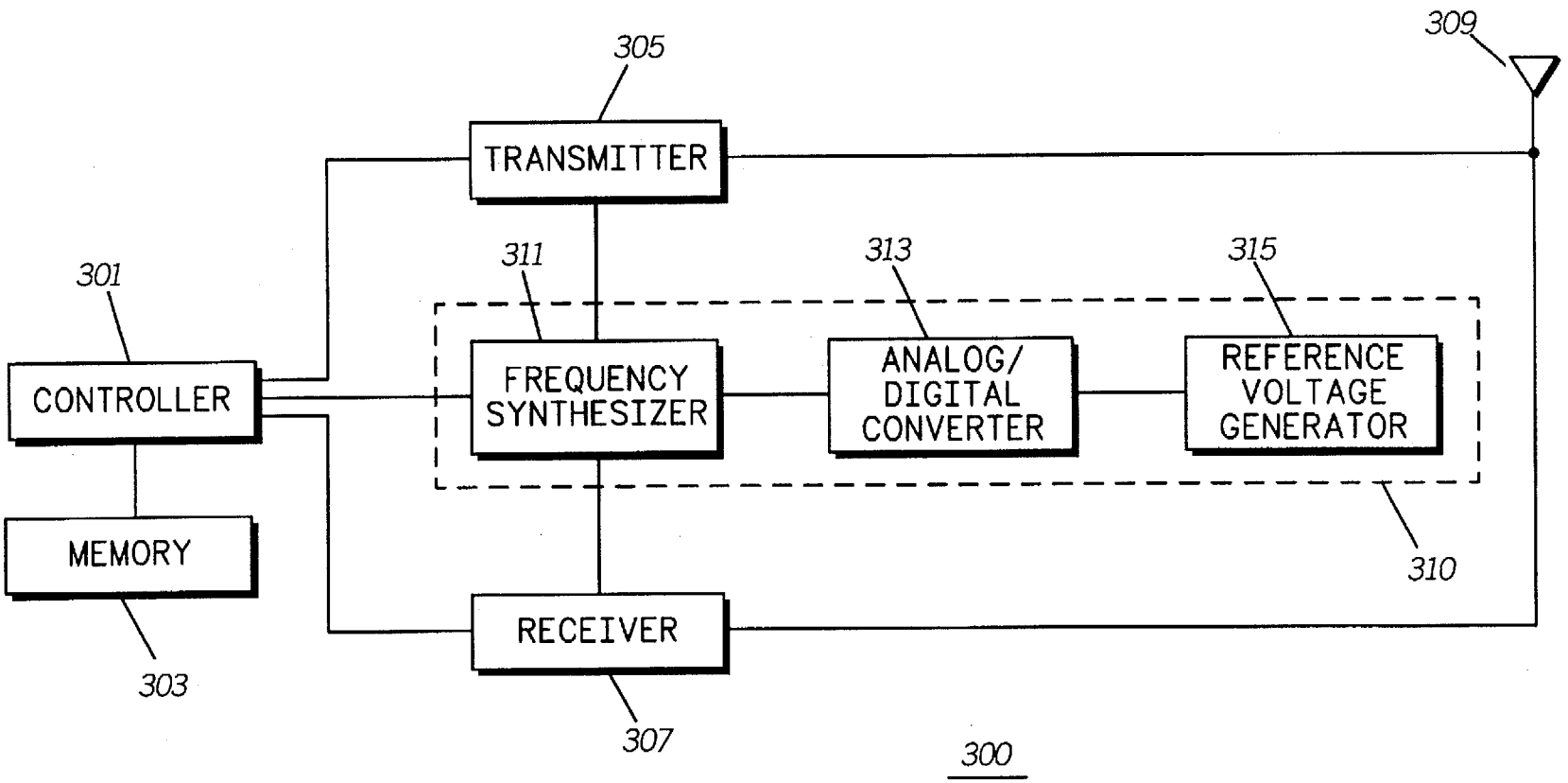
FIG. 3 is a block diagram of a radio communication device that employs the reference voltage generator of FIG. 1, in accordance with the present invention.

FIG. 3 is a block diagram of a radio communication device 300, in accordance with the present invention. In the preferred embodiment, the communication device is a portable two-way radio operable to communicate over radio frequency channels. The radio 300 includes, as communication circuitry, a transmitter 305 and a receiver 307 which are coupled to an antenna 309. The transmitter 305 and receiver 307 operate under the control of a controller 301 according to instructions stored in a coupled memory 303.

The controller 301 is further coupled to a frequency synthesizer 311 that provides frequency related information to the transmitter 305 and to the receiver 307. The frequency synthesizer 311 is coupled to an analog to digital (A/D) converter 313 that converts a signal which has alternate current and direct current components into a digital representation. The A/D converter 313 operates using a reference voltage that is established at a constant offset from an analog ground reference, which in the preferred embodiment is half the supply voltage. The constant offset reference voltage is sourced from a coupled reference voltage generator 315 constructed according to the present invention. Preferably, the frequency synthesizer 311, the A/D converter 313, and the reference voltage generator 100 form part of an integrated circuit 310.

The present invention offers significant advantages. A temperature independent reference voltage is provided which is referenced to a ground voltage that tracks the supply voltage. In the preferred embodiment, the reference voltage is easily scalable by manipulating resistor values. The value of the reference voltage is determined by the ratio of the resistors, and by the bandgap voltage. The bandgap voltage depends on physical characteristics of silicon, for example, which are relatively constant. The combination of the bandgap voltage and resistors that match well with an integrated circuit process provides for a very precise reference. The reference ground voltage is also scalable by appropriate selection of resistor values. The use of a MOSFET transistor to directly couple the current to the operational amplifier provides circuit simplification, eliminating the need for multiple current mirrors and the associated errors, such as caused by current mirror mismatch and temperature dependencies. A reference voltage generator constructed according to the present invention is especially beneficial for low voltage applications.

What is claimed is:

1. A reference generator for generating a constant offset reference voltage relative to a reference ground voltage that tracks a supply voltage, comprising:

a bandgap voltage generator having an output of a bandgap voltage;

a voltage source having an output of a reference ground voltage that is derived by scaling the supply voltage;

a scaler coupled to the output of the bandgap voltage generator and having an output of a scaled voltage based on the bandgap voltage; and a summer coupled to the scaler and to the voltage source and having as output the constant offset reference voltage generated from a summation of the scaled voltage and the reference ground voltage.

2. The reference generator of claim 1, wherein the summer comprises an operational amplifier.

3. The reference generator of claim 2, wherein the operational amplifier has first and second inputs, and an output, and further comprises a negative feedback loop with a first resistor therein coupling the output of the operational amplifier to the first input, and wherein current derived from the bandgap voltage is coupled to the first input, and the second input is coupled to the reference ground voltage.

4. The reference generator of claim 3, wherein the scaler comprises the first resistor, and a second resistor coupling the output of the bandgap voltage generator to electrical ground.

5. The reference generator of claim 3, further comprising a MOSFET, wherein the current derived from the bandgap voltage is coupled to the first input through the MOSFET.

6. The reference generator of claim 5, wherein the bandgap voltage generator comprises the MOSFET.

7. The reference generator of claim 6, wherein:

the bandgap voltage generator comprises a first branch and a second branch connected in parallel, the first branch comprises a first PMOSFET having a source, a drain, and a gate, and a first bipolar transistor having a collector, a base, and an emitter, the source of the first PMOSFET is connected to the supply voltage, and the drain connected to the collector of the first bipolar transistor, the second branch comprises a second PMOSFET having a source, a drain, and a gate, a second bipolar transistor having a collector, a base, and an emitter, and a third resistor, the source of the second PMOSFET is connected to the supply voltage, and the drain of the second PMOSFET is connected to the collector of the second bipolar transistor, the emitter of the second bipolar transistor is connected to the third resistor which is connected to the emitter of the first bipolar transistor, the first and second branches are connected to electrical ground through a fourth resistor, the gate of the first PMOSFET and the gate of the second PMOSFET are connected to the drain of the second PMOSFET, and the base of the first bipolar transistor is connected to the base of the second bipolar transistor; and the MOSFET has a gate connected to the drain of the first PMOSFET, and a source connected to the base of the first bipolar transistor.

8. A reference generator for generating a constant reference voltage relative to a reference ground voltage that tracks a supply voltage, comprising:

a voltage divider coupled to the supply voltage and having an output of the reference ground voltage;

a voltage source having an output voltage derived from the supply voltage, which output voltage is temperature independent and supply independent;

a first resistor coupling the output voltage to electrical ground; and an operational amplifier having first and second inputs, and an output, and having a negative feedback loop with a second resistor therein coupling the output to the first input, and wherein current derived from the voltage source is coupled to the first input, and the second input being coupled to the reference ground voltage.

9. The reference generator of claim 8, wherein the voltage source comprises a bandgap voltage generator that outputs a bandgap voltage.

10. The reference generator of claim 9, wherein the bandgap voltage generator comprises a MOSFET.

11. The reference generator of claim 10, wherein the MOSFET and the first resistor operate to couple current generated from the bandgap voltage to the first input of the operational amplifier.

12. The reference generator of claim 11, wherein:

the bandgap voltage generator comprises a first branch and a second branch connected in parallel, the first branch comprises a first PMOSFET having a source, a drain, and a gate, and a first bipolar transistor having a collector, a base, and an emitter, the source of the first PMOSFET is connected to the supply voltage, and the drain connected to the collector of the first bipolar transistor, the second branch comprises a second PMOSFET having a source, a drain, and a gate, a second bipolar transistor having a collector, a base, and an emitter, and a third resistor, the source of the second PMOSFET is connected to the supply voltage, and the drain of the second PMOSFET is connected to the collector of the second bipolar transistor, the emitter of the second bipolar transistor is connected to the third resistor which is connected to the emitter of the first bipolar transistor, the first and second branches are connected to electrical ground through a fourth resistor, the gate of the first PMOSFET and the gate of the second PMOSFET are connected to the drain of the second PMOSFET, and the base of the first bipolar transistor is connected to the base of the second bipolar transistor; and the MOSFET has a gate connected to the drain of the first PMOSFET, and a source connected to the base of the first bipolar transistor.

13. A generator for generating a reference voltage from a supply voltage, the reference voltage having a constant offset from a reference ground voltage, which reference ground voltage is derived by scaling the supply voltage, comprising:

a current mirror circuit comprising a first branch and a second branch connected in parallel and having a first common node coupled to the supply voltage, and having a second common node coupled to electrical ground via a first resistor, the first branch comprising a first MOSFET transistor and a first bipolar transistor coupled in series, the second branch having a second MOSFET transistor, a second bipolar transistor, and a second resistor connected in series, the first and second bipolar transistors having connected bases at which a bandgap voltage is developed;

a MOSFET transistor coupled at the connected bases of the first and second bipolar transistors;

a third resistor coupling the connected bases of the first and second bipolar transistors to electrical ground;

a voltage divider coupled to the supply voltage and having an output of the reference ground voltage; and an operational amplifier having first and second inputs, and an output, and having a negative feedback loop with a fourth resistor therein coupling the output to the first input, the first input being connected to the MOSFET transistor, the second input being connected to the reference ground voltage;

wherein the third resistor operates to generate a current from the bandgap voltage, which current is coupled by the MOSFET transistor through the fourth resistor to develop the reference voltage.

14. A generator for a constant offset reference voltage that tracks a supply voltage, comprising:

a first voltage source having an output of a reference ground voltage that is derived by scaling the supply voltage;

a bandgap voltage generator having a bandgap voltage output;

an operational amplifier having first and second inputs, and an output, and having a negative feedback loop with a first resistor therein coupling the output to the first input; and a current source based on the bandgap voltage output and coupled to the first input of the operational amplifier;

wherein the current source generates a current from the bandgap voltage output, which current is coupled through the first resistor to develop the constant offset reference voltage.

15. The generator of claim 14, further comprising a MOSFET transistor coupled between the first input of the operational amplifier and the current source.

16. The generator of claim 15, wherein the current source comprises a second resistor coupling the bandgap voltage output to electrical ground.

17. A radio, comprising: communication circuitry;

a frequency synthesizer coupled to the communication circuitry;

a reference voltage generator coupled to the frequency synthesizer, and comprising:

a first voltage source having an output of a reference ground voltage that is derived by scaling a supply voltage;

a bandgap voltage generator having a bandgap voltage output;

an operational amplifier having first and second inputs, and an output, and having a negative feedback loop with a first resistor therein coupling the output to the first input;

a current source based on the bandgap voltage output and coupled to the first input of the operational amplifier;

wherein the current source generates a current from the bandgap voltage output, which current is coupled through the first resistor to develop a constant offset reference voltage.

18. The radio of claim 17, further comprising a MOSFET transistor coupled between the first input of the operational amplifier and the current source.

19. The radio of claim 18, wherein the current source comprises a second resistor coupling the bandgap voltage output to electrical ground.

20. The radio of claim 17, wherein the bandgap voltage generator comprises a MOSFET transistor.

21. The radio of claim 20, wherein the MOSFET transistor and the first resistor operate to couple current generated from the bandgap voltage output to the first input of the operational amplifier.

22. The radio of claim 21, wherein:

the bandgap voltage generator comprises a first branch and a second branch connected in parallel, the first branch comprises a first PMOSFET having a source, a drain, and a gate, and a first bipolar transistor having a collector, a base, and an emitter, the source of the first PMOSFET is connected to the supply voltage, and the drain connected to the collector of the first bipolar transistor, the second branch comprises a second PMOSFET having a source, a drain, and a gate, a second bipolar transistor having a collector, a base, and an emitter, and a third resistor, the source of the second PMOSFET is connected to the supply voltage, and the drain of the second PMOSFET is connected to the collector of the second bipolar transistor, the emitter of the second bipolar transistor is connected to the third resistor which is connected to the emitter of the first bipolar transistor, the first and second branches are connected to electrical ground through a fourth resistor, the gate of the first PMOSFET and the gate of the second PMOSFET are connected to the drain of the second PMOSFET, and the base of the first bipolar transistor is connected to the base of the second bipolar transistor; and the MOSFET transistor has a gate connected to the drain of the first PMOSFET, and a source connected to the base of the first bipolar transistor.

* * * * *